US008453871B2

(12) United States Patent
Dunyon et al.

(10) Patent No.: US 8,453,871 B2
(45) Date of Patent: Jun. 4, 2013

(54) VACUUM RELEASE SYSTEMS

(75) Inventors: Christopher Leon Dunyon, West Haven, UT (US); Bret Dunyon, Salt Lake City, UT (US)

(73) Assignee: Fluid N Motion, Taylorsville, UT (US)

( * ) Notice: Subject to any disclaimer, the term of this patent is extended or adjusted under 35 U.S.C. 154(b) by 103 days.

(21) Appl. No.: 13/173,198

(22) Filed: Jun. 30, 2011

(65) Prior Publication Data

US 2012/0240739 A1 Sep. 27, 2012

Related U.S. Application Data

(60) Provisional application No. 61/454,801, filed on Mar. 21, 2011, provisional application No. 61/492,906, filed on Jun. 3, 2011.

(51) Int. Cl.
*B65D 6/40* (2006.01)

(52) U.S. Cl.
USPC ..... 220/745; 83/30

(58) Field of Classification Search
USPC ..... 30/366, 367; 83/30; 222/484, 525, 222/80, 85, 478, 479, 481, 83; 220/745, 231, 220/277, 278
See application file for complete search history.

(56) References Cited

U.S. PATENT DOCUMENTS

| | | | | |
|---|---|---|---|---|
| 4,069,586 | A * | 1/1978 | Skelton | 30/360 |
| 4,681,243 | A * | 7/1987 | Takasugi | 222/83 |
| 7,163,515 | B2 * | 1/2007 | McNenny | 600/573 |
| 7,284,332 | B2 * | 10/2007 | Long | 30/367 |
| 7,328,731 | B2 * | 2/2008 | Russell | 141/329 |
| 2001/0000793 | A1 * | 5/2001 | Daubert et al. | 604/200 |
| 2003/0142180 | A1 * | 7/2003 | Gonzales | 347/86 |
| 2006/0011640 | A1 * | 1/2006 | Shaygan | 220/745 |
| 2006/0042101 | A1 | 3/2006 | Roefs | |
| 2006/0150789 | A1 | 7/2006 | Russell | |
| 2006/0236552 | A1 * | 10/2006 | Giles | 30/366 |

* cited by examiner

*Primary Examiner* — Kevin P Shaver
*Assistant Examiner* — Bob Zadeh
(74) *Attorney, Agent, or Firm* — Olympic Patent Works PLLC

(57) ABSTRACT

Vacuum release systems that allow rapid, uninterrupted flow of a liquid through a first opening in a container when the container is inverted are disclosed. The vacuum release systems includes a holes punch and can be secured to the outer surface of the container. When the liquid-filled container is inverted, pressure is applied to the hole punch to form a second opening in the side of the container. The second opening releases the vacuum by allowing air to flow into the container, which, in turn, allows rapid, uninterrupted flow of the liquid through the first opening in the container.

12 Claims, 9 Drawing Sheets

VACUUM RELEASE SYSTEMS

CROSS-REFERENCE TO RELATED APPLICATIONS

This application claims the benefit of Provisional Application No. 61/454,801, filed Mar. 21, 2011 and Provisional Application No. 61/492,906, filed Jun. 3, 2011.

TECHNICAL FIELD

This disclosure is directed to systems for releasing a vacuum in an open inverted container.

BACKGROUND

A liquid can be slowly and steadily drained through a single opening in a container by tilting the container so that air can also flow into the container through the opening to fill the volume occupied by the liquid flowing out of the container. However, in an effort to increase the flow rate of the liquid from the container, one typically inverts the container but the liquid contents block the opening, preventing air from entering the container. As a result, a vacuum forms within the container which is repeatedly released when small amounts of the liquid falls through the opening followed by corresponding volumes of air that rapidly rush into the container through the same opening, briefly stopping the flow of the liquid. This repeated interruption in the flow of the liquid causes the container to jolt up and down and sideways as the mass of the liquid contents rapidly changes with each quick release of a small amount of the liquid through the opening. The jolts subside and a smooth steady flow of the liquid eventually occurs after much of the liquid is emptied and can no longer prevent the flow of air into the container.

SUMMARY

Vacuum release systems that allow rapid, uninterrupted flow of a liquid through a first opening in a container when the container is inverted are disclosed. The vacuum release systems includes a hole punch and can be secured to the outer surface of the container. When the liquid-filled container is inverted, pressure applied to the hole punch forms a second opening in the side of the container. The second opening releases the vacuum by allowing air to flow into the container through the second opening, which, in turn, allows the liquid contents to be rapidly emptied from the container through the first opening without interruption in the flow.

DETAILED DESCRIPTION

Figure 1A:
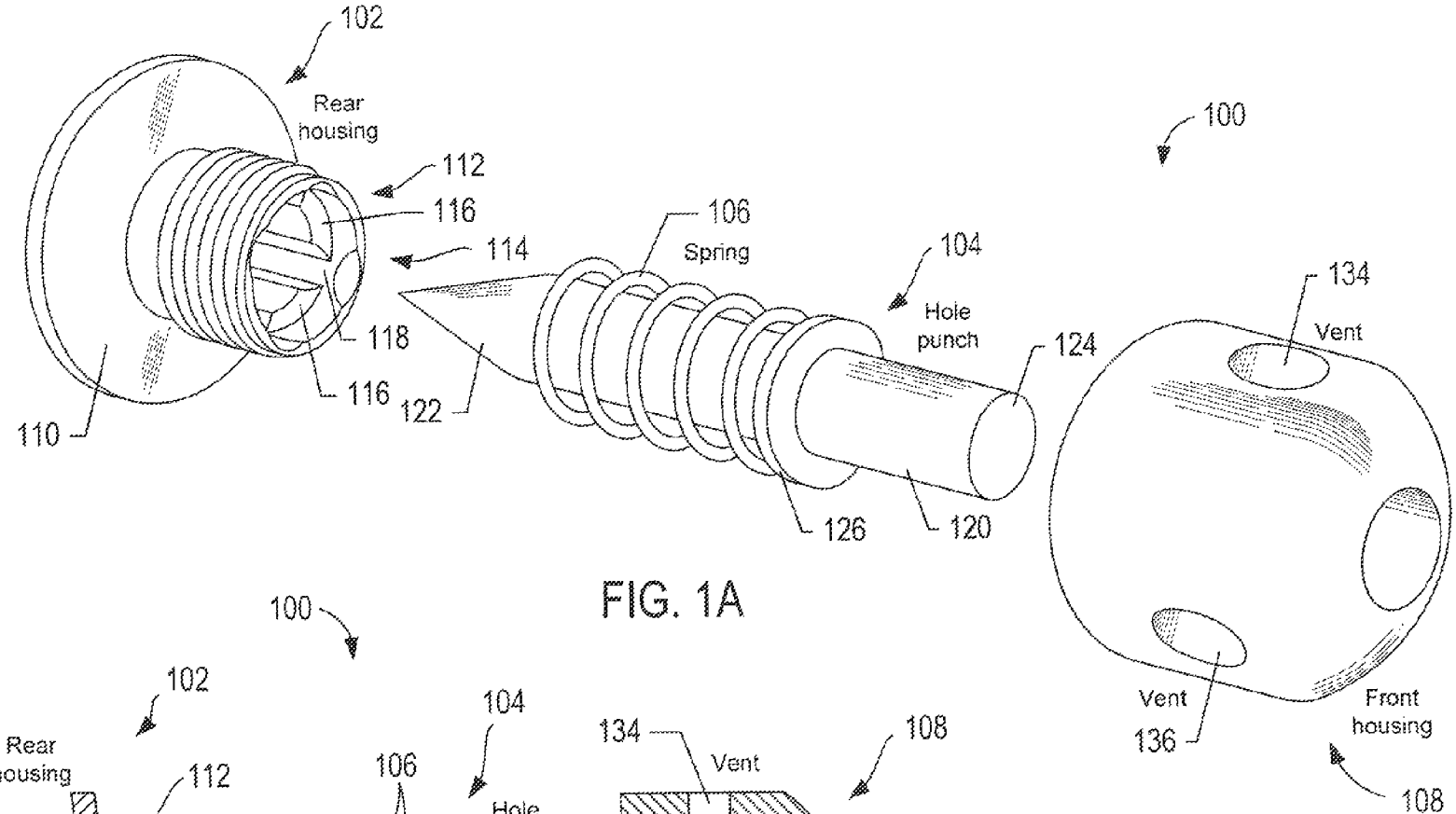
FIGS. 1A-1B show exploded perspective and cross-sectional views of an example vacuum release system.
Figure 1B:
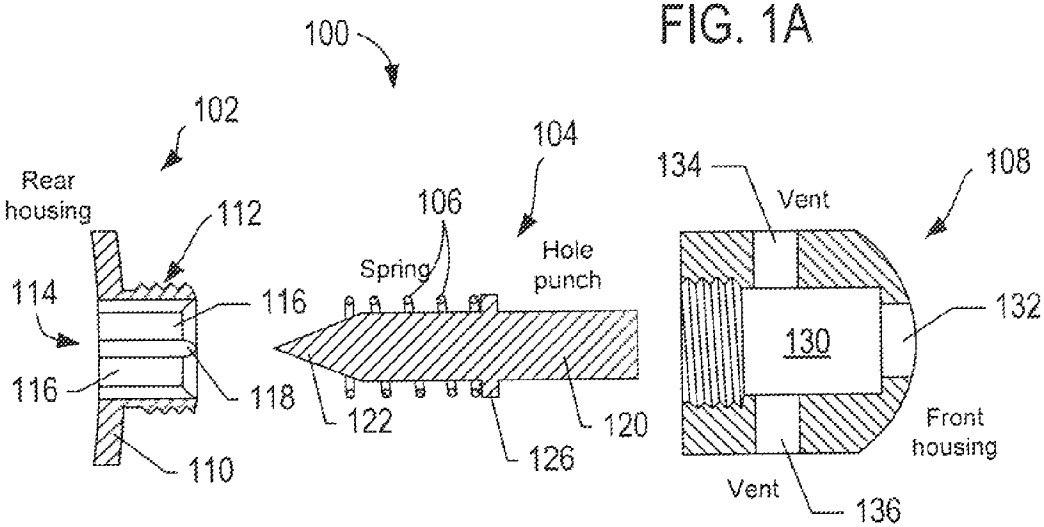

Various vacuum release systems embodiments are now described. FIGS. 1A-1B show exploded perspective and cross-sectional views of an example vacuum release system 100. The system 100 includes a rear housing 102, a hole punch 104, a coiled spring 106, and a front housing 108. The rear housing 102 includes a ring-shaped perforated plate 110 and a threaded male end 112. The perforated plate 110 and male end 112 include an opening 114 with guides 116 separated by grooves 118 to receive the hole punch 104. FIG. 1B also reveals how the perforated plate 110 is curved. For example, the perforated plate 110 can have a cylindrical concave shape. The punch 104 includes a shaft 116 with a tapered end 122, a butt end 124, and a ring 126 located along the shaft. The front housing 108 includes an opening that extends the length of the front housing. In the particular, as shown in FIG. 1B, the opening includes a threaded female section 128 dimensioned to receive the threaded male end 112 of the rear housing 102, an intermediate cylindrical section 130 dimensioned to receive the ring 126 of the punch 104, and a narrower third cylindrical section 132 dimensioned to receive the shaft 120 of the punch 104. The front housing 108 also includes four symmetrically distributed vents, two of which 134 and 136 are shown. The vents open into the intermediate opening 130 and are oriented substantially perpendicular to the central axis of the opening 130 in the front housing 108. The front housing 108 is not limited to having four vents. In other embodiments, the front housing 108 can have as few as one vent or two or more vents. As shown in the example of FIGS. 1A-1B, the diameter of the spring 106 is dimensioned to receive the shaft 120 of the punch 104 along the cylindrical axis of the spring.

Figure 2:
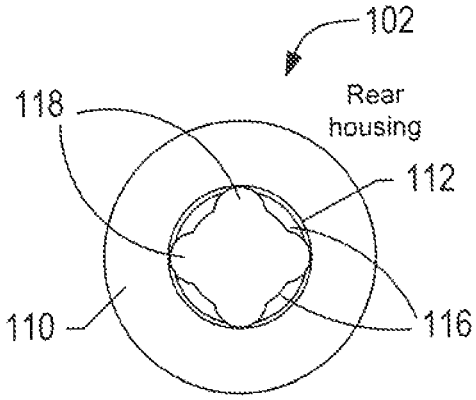
FIG. 2 shows a front plan view of an example rear housing of a vacuum release system.

FIG. 2 shows a front plan view of the example rear housing 102. The guides 116 extend the length of the opening 114 and are curved to receive the cylindrical shaft of the punch 104. FIG. 2 also reveals semicircular-shaped grooves that extend the length of the opening 114 and separate the guides 116. In the example of FIG. 2, the rear housing 102 includes four guides 116 separated by four symmetrically distributed grooves 118. The number of guides and grooves in the opening 114 is not limited to four and the guides and grooves do not have to be symmetrically distributed. In other embodiments, the opening 114 may have a single C-shaped guide and one groove or the opening 114 may have two or more guides separated by grooves that extend the length of the opening 114.

Figure 3:
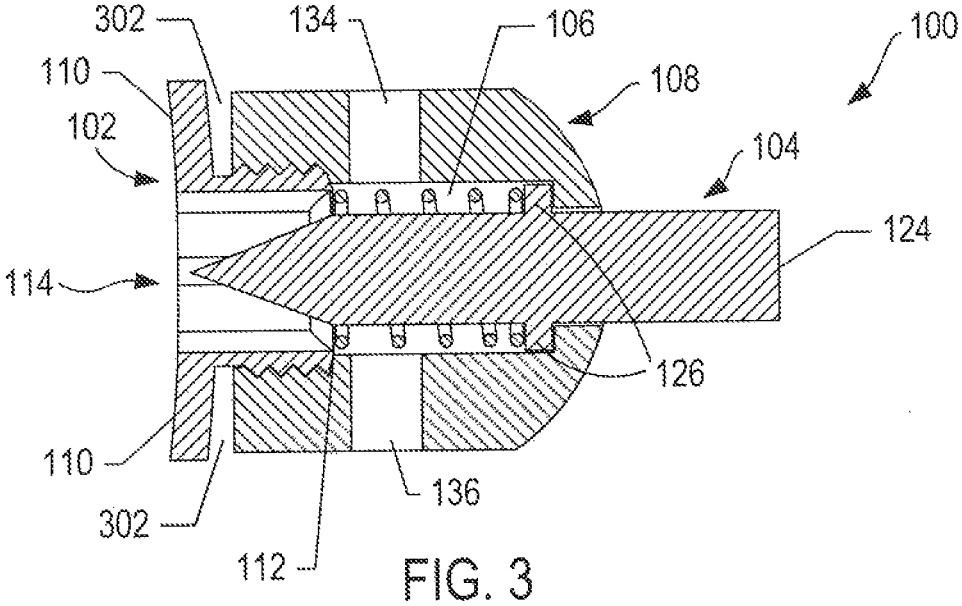
FIG. 3 shows a cross-sectional view of the example vacuum release system shown in FIG. 1 fully assembled.

FIG. 3 shows a cross-sectional view of the example vacuum release system 100 fully assembled. The cross-sectional view shows the male end 112 of the rear housing 102 inserted into the female section 128 of the front housing 108 to form a housing for the spring 106 and the punch 404. When the male end 112 is fully screwed into the threaded female section 128 of the front housing 108, a ring-shaped gap 302 exists between the perforated plate 110 of the rear housing 102 and the base of the front housing 108. The third section 132 and guides 116 form a cylindrical guide to direct the motion of the punch 104 when pressure is applied to the butt end 124. FIG. 3 also reveals that a first end of the spring 106 abuts the ring 126 of the punch 104 and a second end of the spring 106 abuts the end of the male end 112 of the rear housing 102.

Figure 4:
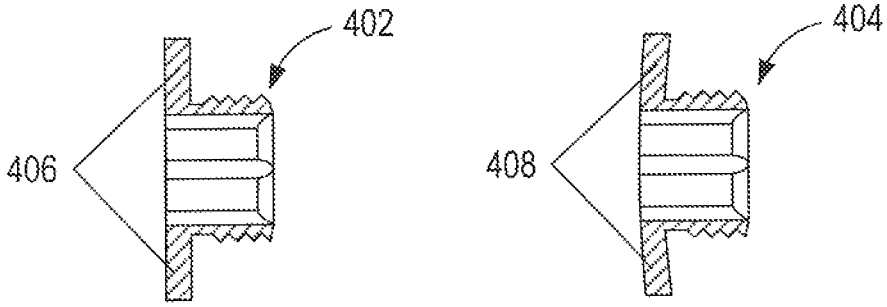
FIG. 4 shows cross-sectional views of two examples of rear housings.

The perforated plate 110 of the rear housing 102 is not limited to a cylindrical concave shape shown in the cross-sectional view of FIGS. 1B and 3. FIG. 4 shows cross-sectional views of two example rear housings 402 and 404. The rear housing 402 includes a flat perforated plate 406, while the rear housing 404 includes a cylindrical convex-shaped perforated plate 408.

Figure 5B:
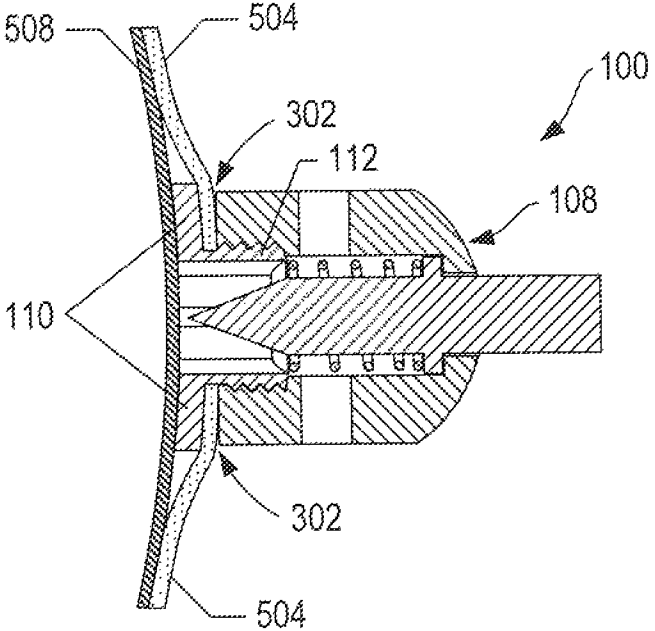
FIGS. 5A-5F show isometric and cross-sectional views of an implementation of the example vacuum release system shown in FIG. 1.
Figure 5A:
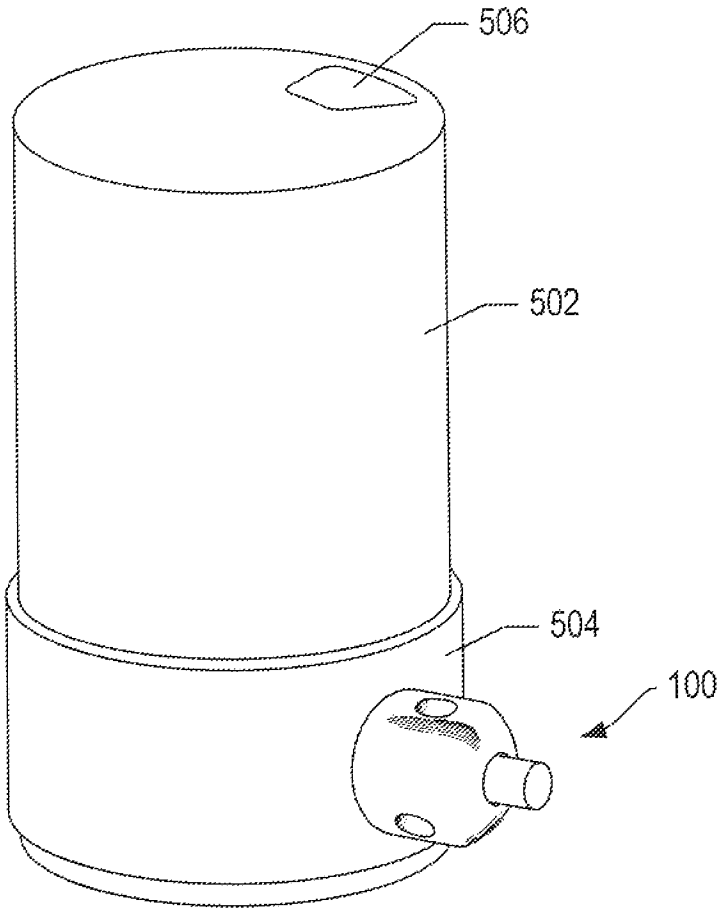
Figure 5D:
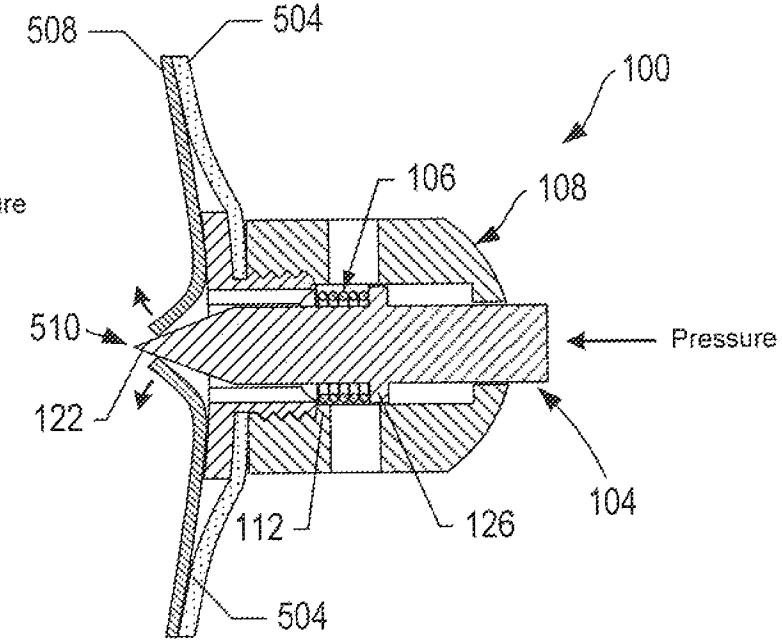
Figure 5C:
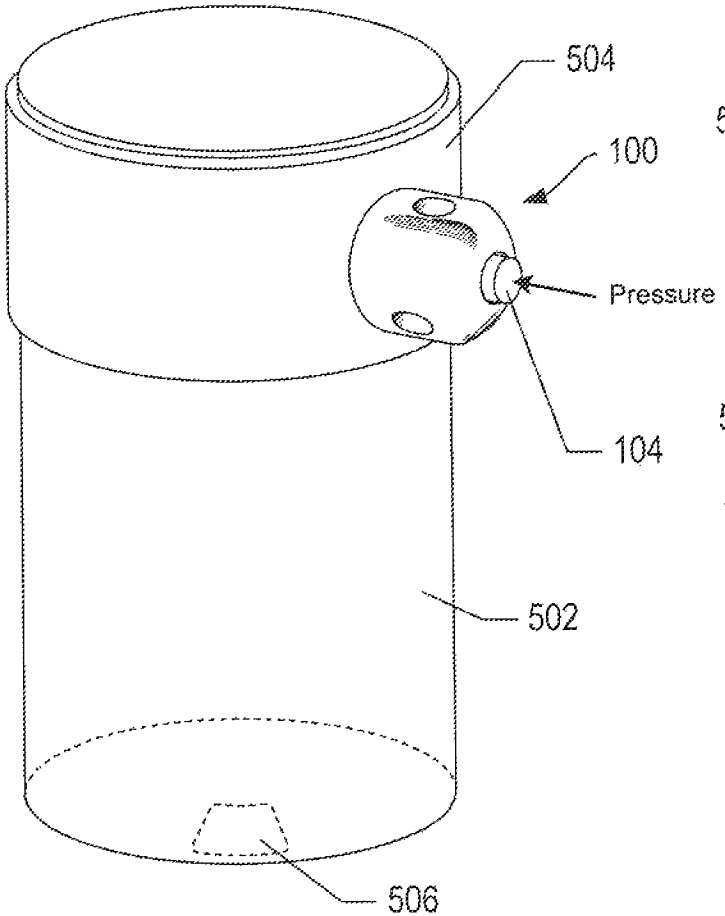
Figure 5F:
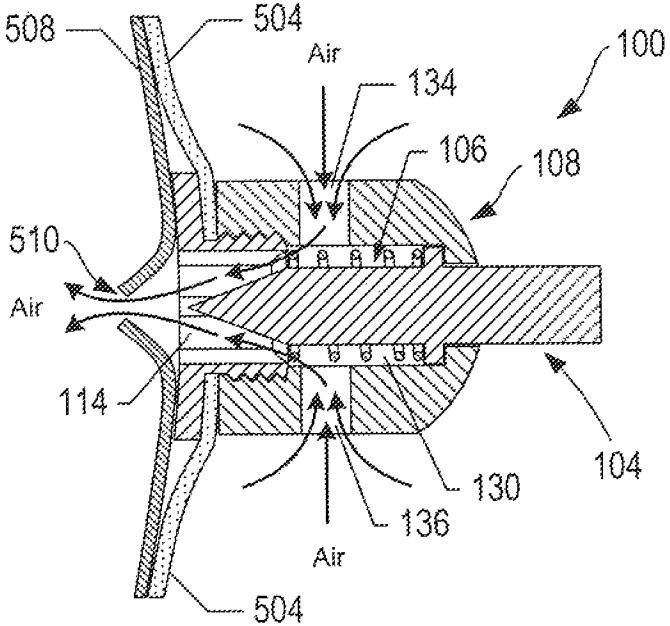
Figure 5E:
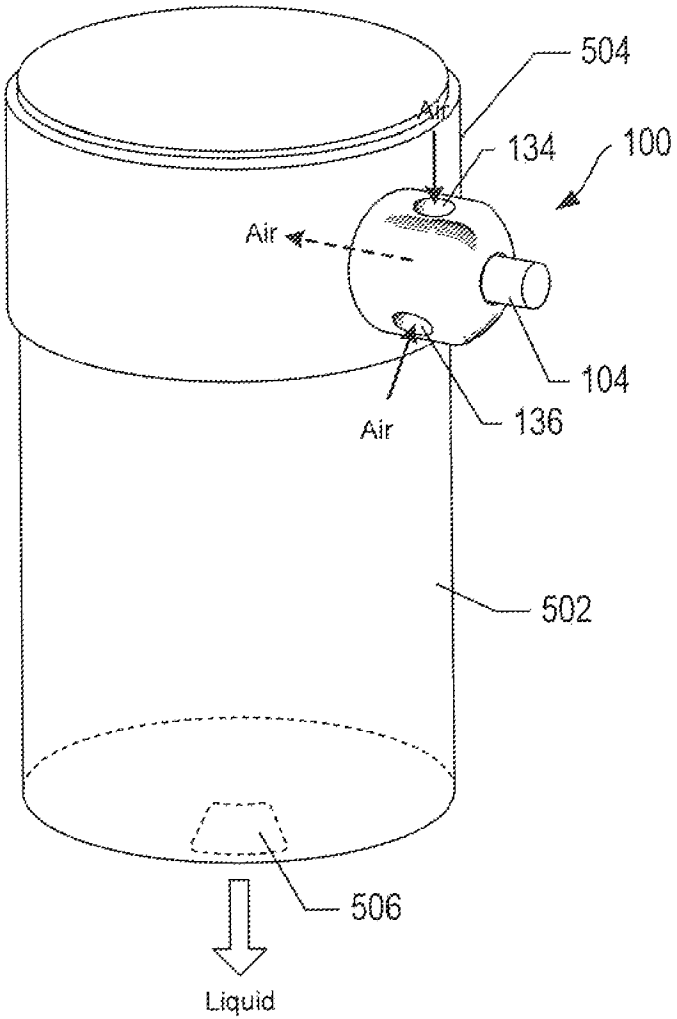

FIGS. 5A-5F show isometric and cross-sectional views of an example implementation of the vacuum release system 100. In FIG. 5A, the system 100 is secured near the base of a liquid-filled container 502 with a sleeve 504 that wraps around the base of the container 502. The container 502 includes a small first opening 506 through which the liquid contents of the container are to be emptied. Although, the sleeve 504 is shown as a wrap that encompasses a portion of the cylindrical wall of the container 502, the sleeve can include a base (not shown) so that the sleeve can encase the bottom and cylindrical wall of the container. The sleeve can be composed of a fabric, foam, or an insulating material. FIG. 5B shows a cross-sectional view of the system 100 firmly attached to a portion 508 of the cylindrical wall of the container 502. The sleeve 504 includes an aperture through which the male end 112 of the rear housing 110 is inserted. As shown in the cross-sectional view, the perforated plate 110 of the rear housing 102 is disposed between the wall 508 and the sleeve 504 and a portion of the sleeve 504 surrounding the aperture substantially fills the cylindrical-shaped gap 302 between the perforated plate 110 and the base of the front housing 108. In FIG. 5C, the container 502 is inverted to empty the liquid contents through the first opening 506. When the container 502 is inverted, as shown in FIG. 5C, a vacuum forms inside the container 502, which is released when pressure is applied to the hole punch 104 so that the tapered end 122 of the punch punctures or forms a second opening 510 in the wall 508 of the container 502, as shown in FIG. 5D. FIG. 5D also reveals that the spring 106 is compressed between the edge of the male end 112 of the pack plate 102 and the ring 126 of the punch 104. When the pressure applied to the punch 104 is released, the spring 106 restores the position of the punch 104, as shown in the cross-sectional view of FIG. 5F. In FIGS. 5E-5F, the vacuum is released as the liquid begins to empty through the first opening 506 and air is drawn into the container 502 through the vents 134 and 136 in the front housing 108. FIG. 5F reveals that air passes through the vents 134 and 136 to the opening 130 of the front housing 108 and the opening 114 in the rear housing 102 to reach the interior of the container 502. As shown in FIG. 5E, the second opening 510 releases the vacuum formed in the inverted container 502 by allowing air to flow into the container 502 through the vents 134 and 136 of the front housing 108. As a result, the liquid contents of the container 502 can rapidly flow uninterrupted through the first opening 506.

Figure 6A:
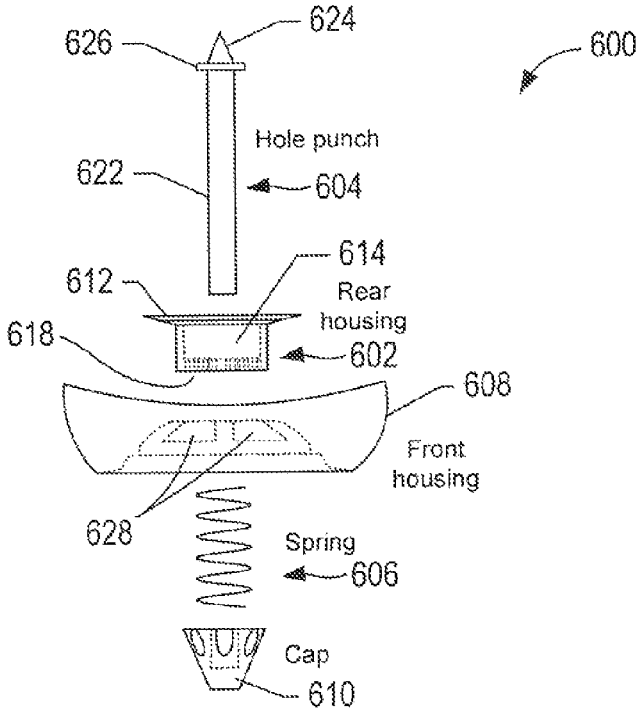
FIGS. 6A-6B show exploded and partially assembled perspective views, respectively, of an example vacuum release system.
Figure 6B:
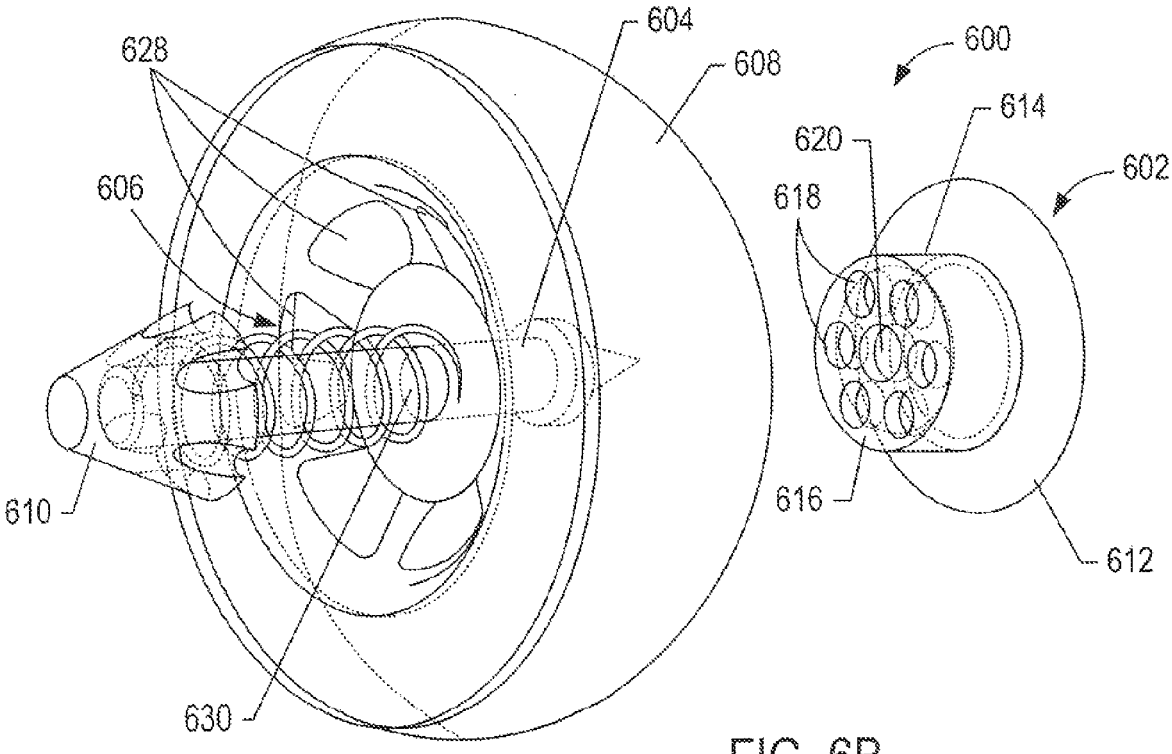

Vacuum release systems are not intended to be limited to the configuration and type of components associated with the vacuum release system 100. FIGS. 6A-6B show exploded and partially assembled perspective views, respectively, of an example vacuum release system 600. The system 600 includes a rear housing 602, a hole punch 604, a coiled spring 606, a front housing 608, and a cap 610. In FIG. 6B, the rear housing 602 is shown separate from the other components of the system 600 to reveal that the rear housing 602 includes a ring-shaped perforated plate 612 and a cylinder 614 that opens into the opening of the perforated plate 612 and has a base 616 with a number of vents 618 formed around a central opening 620. The punch 604 includes a shaft 622, a tapered end 624, and a ring 626 disposed at the end of the shaft near the tapered end 624. The front housing 608 includes vents 628 distributed around a central opening 630 that is dimensioned to receive the shaft 622 of the punch 604. The vents 628 in the front housing 608 and vents 618 in the rear housing 602 allow air to flow along the central axis of the system 600. As shown in FIG. 6B, the cap 610 is attached to the butt end of the punch and the spring 606 is positioned along the shaft 622 between the cap 610 and the front housing 608. The cap 610 can be attached to the end of the shaft 622 with an adhesive, weld, or the cap 610 and the end portion of the shaft 622 can be threaded so the cap 610 is screwed onto the end of the punch 604.

Figure 7A:
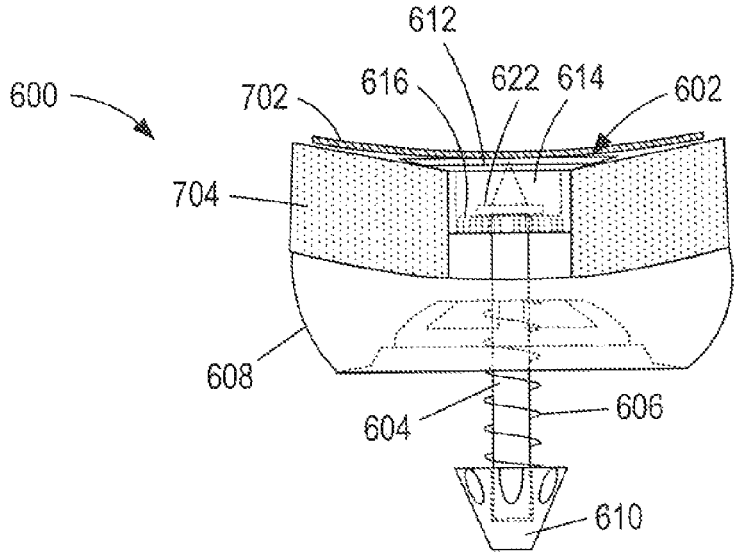
FIGS. 7A-7C show views of an implementation of the vacuum release system shown in FIG. 6 fully assembled.
Figure 7B:
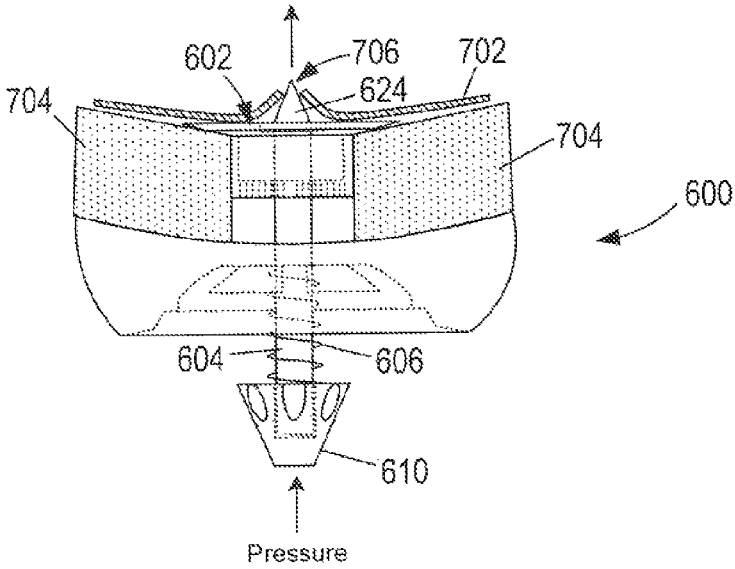
Figure 7C:
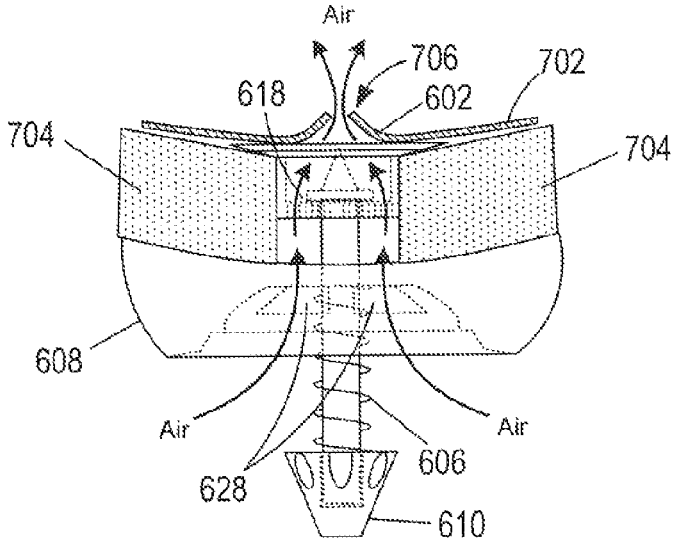

Operation of the system 600 is analogous to operation of the system 100 described above with reference to FIG. 5. FIGS. 7A-7C show views of an example implementation of the system 600 fully assembled. FIG. 7A shows the system 600 attached to a portion of a wall 702 of a container (not shown) and a portion of a sleeve 704 that wraps around the container. The sleeve 704 can be positioned away from a first opening in the container, as described above with reference to FIG. 5A. The sleeve 704 includes an aperture through which the cylinder 614 of the rear housing 602 is inserted. As shown in FIG. 7A, the spring 606 is slightly compressed between the front housing 608 and the cap 610 and thereby exerts an outward directed force that holds the system 600 together by forcing the ring 622 of the punch 604 against the base 616 of the cylinder 614. As a result, the ring-shaped perforated plate 612 of the rear housing 602 is driven toward the front housing 608 compressing portions of the sleeve 704 between the perforated plate 612 and the front housing 608. As shown in FIG. 7B, when the container is inverted, as described above with reference to FIG. 5B, pressure applied to the cap 610 compresses the spring 606 so the punch 604 can puncture or form a second opening 706 in the wall 702. When the pressure applied to the punch 604 is released, the spring 606 restores the position of the punch 604, as shown in the cross-sectional view of FIG. 7C. The vacuum formed in the container when the container is inverted is released as air is drawn into the container through the vents 628 in the front housing 608 and vents 618 in the rear housing 602 along the central axis of the system 600, enabling the liquid contents of the container to rapidly exit the container through the first opening.

Figure 8A:
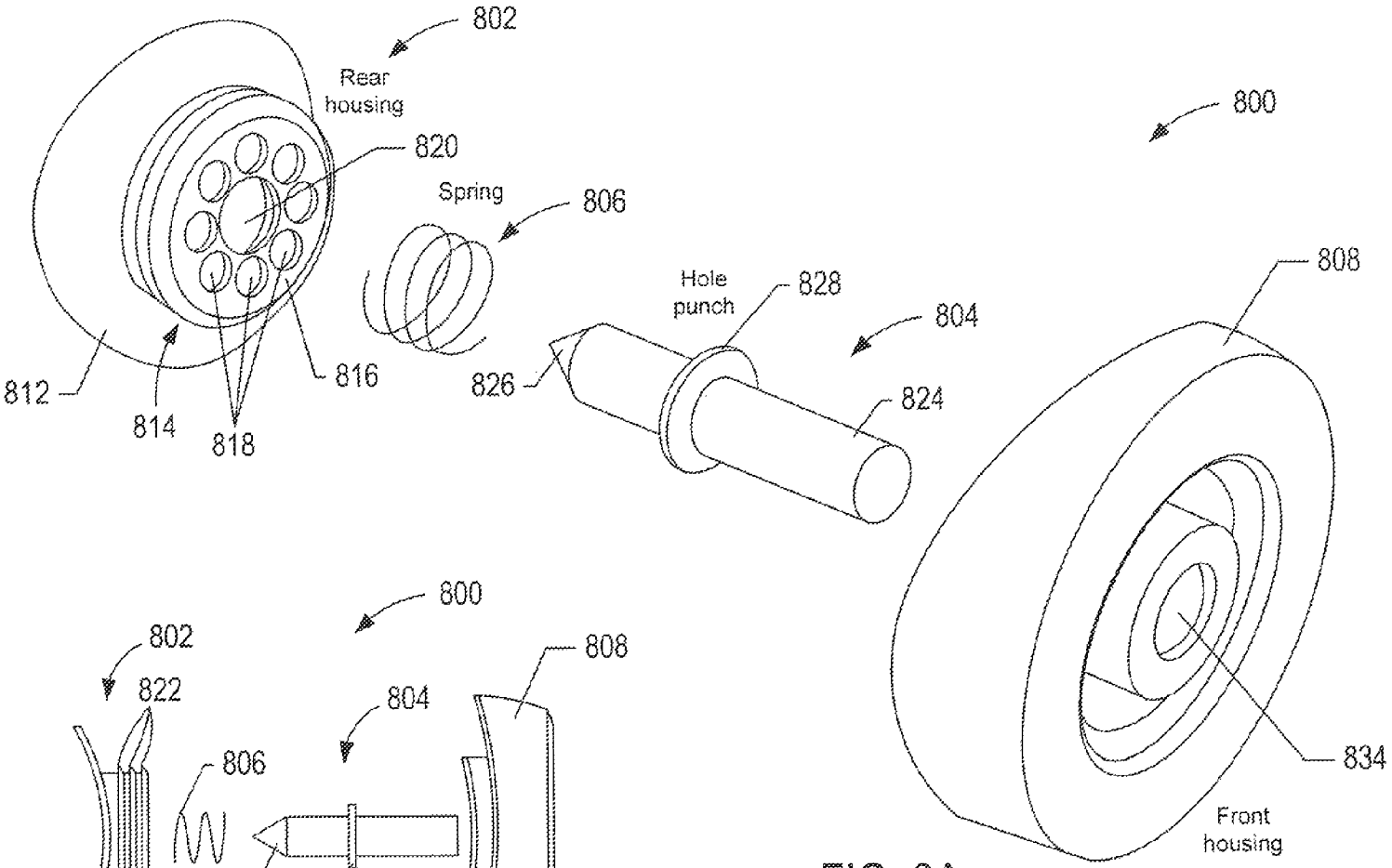
FIGS. 8A-8C show views of an example vacuum release system.
Figure 8B:
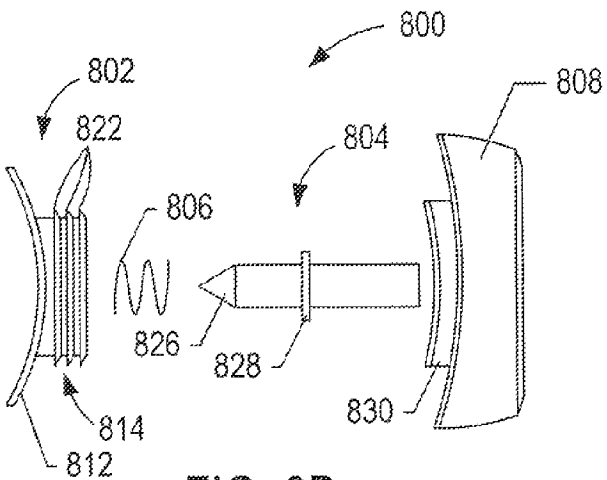
Figure 8C:
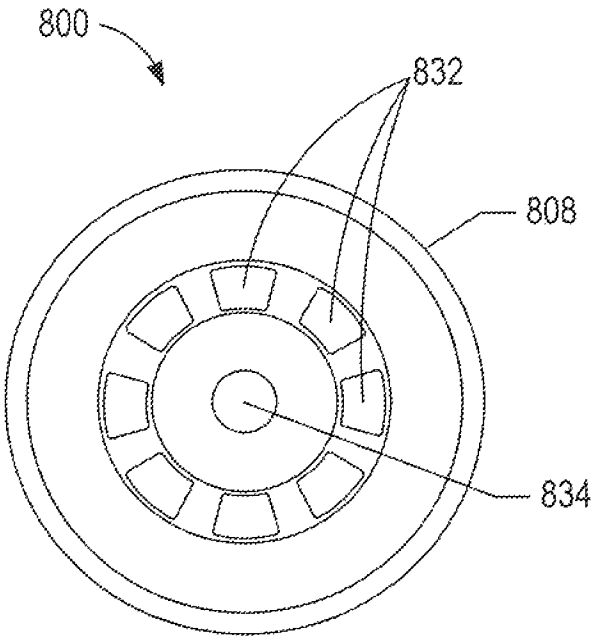

FIGS. 8A-8B show exploded perspective and top plan views, respectively, of an example vacuum release system 800. The system 800 includes a rear housing 802, a hole punch 804, a coiled spring 806, and a front housing 808. In FIG. 8A, the rear housing 802 includes a ring-shaped perforated plate 812 and a cylinder 814 that has a perforated base 816 with a number of vents 818 distributed around a central opening 820. The exterior of the cylinder 814 also includes three concentric, tapered ribs or flanges 822. The punch 804 includes a shaft 824, a tapered end 826, and a ring 828 disposed along the shaft 824. In FIG. 8B, the front housing 808 includes a cylindrical female end 830 for receiving the cylinder 814, as shown in and described below with reference to FIG. 9. FIG. 8C also shows a front view of the front housing 808. The front housing 808 includes vents 832 distributed around a central opening 834 (also shown in FIG. 8A) dimensioned to receive the shaft 824 of the punch 804. The openings 820 and 834 form a guide to direct the punch 824. The vents 832 in the front housing 808 and vents 818 in the rear housing 802 allow air to flow along the central axis of the system 800.

Figure 9:
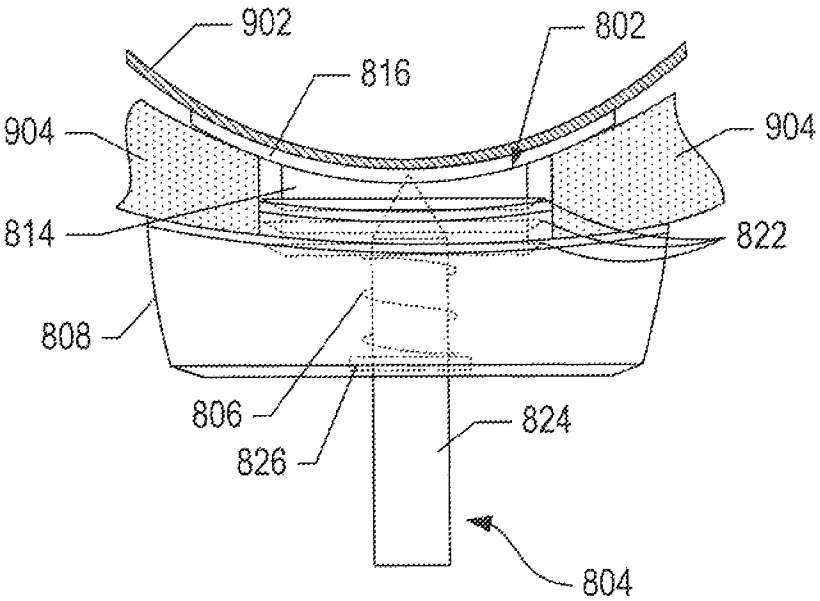
FIG. 9 shows a top plan view of the vacuum release system shown in FIG. 8 fully assembled.

FIG. 9 shows a top plan view of the system 800 fully assembled. The rear housing 802 is joined with the front housing 808 to form a housing for the spring 806 and the punch 804. The spring 806 is located along the shaft 824 between the ring 828 and the base 816 of the rear housing 802. The system 800 attaches to a wall 902 of a container (not shown) and a sleeve 904 that wraps around the container. The sleeve can be positioned away from a first opening in the container, as described above with reference to FIG. 5A. The sleeve includes an aperture through which the male end 814 of the rear housing 802 and the female end of the front housing 808 are inserted. A portion of the sleeve 904 surrounding the aperture is located within a gap between the perforated plate 812 and the front housing 808. The rear housing 802 is secured to the front housing when the male end 814 of the rear housing 802 is inserted into the female end 830 of the front housing. Alternatively, the male cylinder 814 and the front cylinder 830 can be threaded so that cylinder 814 can be screwed into the cylinder 830 to form a housing for the spring 806 and the punch 804. As shown in FIG. 9, the spring 806 is compressed between the ring 828 and the base 816 of the rear housing 802 thereby exerting an outward directed force that keeps the punch 804 extended. The system 800 is operated in the same manner as the systems 100, 600, and 800 by applying pressure to the punch 804 to form a second opening in the container wall.

Note that in the above described examples, the hole punches are described as having cylindrical shaped shafts and the rear and front housings include circular shaped openings dimensioned to receive the shafts and operate as guides along which the punch slides. However, embodiments of the vacuum release systems are not intended to be so limited. Hole punches can also have square, rectangular, triangular, or any other polygonal cross-sectional shape, and the corresponding openings in the rear and front housings can be similarly shaped to receive the cross-sectional shapes of the shafts.

The above describe rear and front housings, hole punches, and caps can be composed of any combination of plastics, thermoplastics, aluminum, steel, or any other suitable material. The rear and front housings, hole punches, and caps can be fabricated using any combination of injection molding and/or machining to achieve the desire shape and size of the vacuum release system components.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the following claims and their equivalents:

The invention claimed is:

1. A vacuum release system comprising:

a hole punch having a shaft and a ring located along the shaft;

a coiled spring having a first end and a second end; and a housing including two aligned and opposing openings, wherein the housing encloses the spring and a portion of the hole punch with the shaft disposed within the two openings and the spring located along the shaft such the first end abuts the ring and the second end abuts the housing surrounding one of the openings, and the housing includes at least one first vent located in the housing around one of the openings and at least one second vent located in the housing around the other opening, and the at least one first vent is opposite the at least one second vent.

2. The system of claim 1, wherein the housing further comprises at least one vent located in the housing substantially perpendicular to the shaft of the punch.

3. The system of claim 1, wherein the two openings are guides to steady and direct the punch.

4. A vacuum release system comprising:

a hole punch having a shaft with a tapered end, a butt end, and a ring located along the shaft;

a rear housing having a first opening dimensioned to receive the shaft of the punch;

a front housing having a second opening dimensioned to receive the shaft; and a spring located along the shaft, wherein the front housing and rear housing are connected with the first opening aligned with the second opening to form a guide to steady and direct the punch oriented with the tapered end toward the rear housing and the butt end extending through the second opening in the front housing, and wherein the front housing includes at least one vent located away from the first opening and the rear housing includes at least one vent located away from the second opening to allow air to flow through the at least one vent in the front housing and the at least one vent in the rear housing.

5. The system of claim 4, wherein the rear housing further comprises a threaded section in which the second opening is located and the front housing further comprises a threaded female section in which the first opening is located.

6. The system of claim 4, wherein the rear housing further comprises guides separated by grooves, the guides dimensioned to receive the shaft of the punch.

7. The system of claim 4, wherein the housing further comprises at least one vent located in the housing substantially perpendicular to the shaft of the punch.

8. The system of claim 4, wherein the spring is located along the shaft between the ring and the rear housing.

9. The system of claim 4, further comprises a cap attached to the butt end of the punch, wherein the spring is located along the shaft between the front housing and the cap.

10. A method to release a vacuum in an inverted, liquid filled container, the method comprising:

placing a sleeve around the container away from a first opening in the container, the sleeve having an aperture;

attaching a vacuum release system to the sleeve, the vacuum release system including a rear housing, a front housing, and a punch, wherein attaching the release system includes:

positioning the rear housing located between the sleeve and the container and an opening in the rear housing is aligned with the aperture in the sleeve, and attaching the front housing to the rear housing so that an opening in the front housing is aligned with the opening in the rear housing and the punch having a tapered end is oriented with the tapered end directed toward the container;

inverting the container so that the first opening is directed substantially downward; and applying pressure to the punch to form a second opening in the container, wherein the second opening allows air to enter the container to release a vacuum so that the liquid rapidly flows uninterrupted through the first opening.

11. The method of claim 10, further comprises releasing pressure applied to the punch to remove the punch from the second opening.

12. The method of claim 10, wherein the vacuum release system includes:

a coiled spring having a first end and a second end; and a housing including two aligned and opposing openings, wherein the housing encloses the spring and a portion of the hole punch, the hole punch having a shaft and a ring located along the shaft, the shaft disposed within the two openings and the spring located along the shaft such the first end abuts the ring and the second end abuts the housing surrounding one of the openings.

* * * * *